US006526707B2

(12) United States Patent
Tucker

(10) Patent No.: US 6,526,707 B2
(45) Date of Patent: Mar. 4, 2003

(54) TRIM STRIP FOR USE AROUND WINDOW AND DOOR OPENINGS AND METHOD OF INSTALLING THE SAME

(76) Inventor: Donald Gordon Tucker, 227 Findlay Road, Quesnel, British Columbia (CA), V2J 4K6

( * ) Notice: Subject to any disclaimer, the term of this patent is extended or adjusted under 35 U.S.C. 154(b) by 0 days.

(21) Appl. No.: 09/901,423

(22) Filed: Jul. 9, 2001

(65) Prior Publication Data

US 2002/0002808 A1 Jan. 10, 2002

(51) Int. Cl.[7] ..... E06B 1/04

(52) U.S. Cl. ..... 52/211; 52/204.53; 52/287.1; 52/717.01; 52/717.05; 52/717.06

(58) Field of Search ..... 52/211, 212, 204.53, 52/204.54, 717.01, 717.03, 717.05, 717.06, 287.1

(56) References Cited

U.S. PATENT DOCUMENTS

| | | | | | |
|---|---|---|---|---|---|
| 3,975,875 | A | * | 8/1976 | Goss, Jr. | 52/204 |
| 4,272,931 | A | | 6/1981 | Stanizzo | |
| 4,341,048 | A | * | 7/1982 | Minter | 52/211 |
| 4,389,824 | A | * | 6/1983 | Anderson | 52/211 |
| 4,391,072 | A | * | 7/1983 | Moore | 52/211 |
| 4,407,100 | A | | 10/1983 | Huelsekopf | |
| 4,682,451 | A | * | 7/1987 | Hubble | 52/97 |
| D296,134 | S | | 6/1988 | Meshulam | |
| 4,787,184 | A | | 11/1988 | Boidron | |
| 4,843,790 | A | * | 7/1989 | Taravella | 52/211 |
| 4,972,640 | A | | 11/1990 | DiFazio | |
| D344,597 | S | | 2/1994 | Bancroft | |
| 5,369,922 | A | | 12/1994 | Hansen | |
| 5,660,010 | A | | 8/1997 | Sayers | |
| D406,663 | S | | 3/1999 | Morton et al. | |
| 5,893,243 | A | * | 4/1999 | Ortner | 52/211 |
| 5,941,033 | A | | 8/1999 | Adams | |
| 6,360,500 | B1 | * | 3/2002 | Wilcox | 52/217 |
| 6,360,508 | B1 | * | 3/2002 | Pelfrey et al. | 52/520 |

OTHER PUBLICATIONS

Gentak Building Products Limited product information sheet No. 628–1800E, entitled: "Window & Door Surround" Vinyl Accessories, dated Jan. 1, 1998, 1 page.

Gentak Building Products Limited product information sheet No. 626–1300E entitled: "Concord—Vinyl Siding Accessories", dated Jan. 1, 1998, 1 page.

* cited by examiner

*Primary Examiner*—Yvonne M. Horton
(74) *Attorney, Agent, or Firm*—Davis & Bujold, P.L.L.C.

(57) ABSTRACT

A trim strip for use around window and door opening and a method of installing the same. The trim strip includes a unitary body having an elongate first planar portion and an elongate second planar portion in parallel spaced relation. A second edge of the second planar portion is connected to a second edge of the first planar portion. A third planar portion is secured substantially perpendicularly to a first edge of the first planar portion and extends transversely in spaced relation past a first end of the second planar portion. The trim strip is intended for installation onto any building after a "J" strip trim or equivalent has been secured around the window and door openings. It is particularly suited for retrofitting a building that has exterior siding.

5 Claims, 1 Drawing Sheet

TRIM STRIP FOR USE AROUND WINDOW AND DOOR OPENINGS AND METHOD OF INSTALLING THE SAME

FIELD OF THE INVENTION

The present invention relates to a trim strip for use around window and door openings and a method of installing the same. The trim strip has particular application to buildings having exterior siding.

BACKGROUND OF THE INVENTION

When installing siding, trim is placed around window and door openings as an initial step before the balance of the siding is installed. The form of trim most commonly used is referred to as a "J" strip; so named because of it's shape. The "J" strip has an upwardly extending tail portion which is secured to a wall and a hook portion into which siding is inserted.

As the trim is placed on as an initial step, it is not removable or alterable once the siding is completed. This has some inherent limitations. There is no flexibility to subsequently change the trim to suit the tastes of a new owner or update the look of the residence. Alterations are expensive and time consuming.

SUMMARY OF THE INVENTION

What is required is a trim strip that is capable of being installed after the siding has been applied to retrofit and change the appearance of a home that has "J" strip trim.

According to one aspect of the present invention there is provided a trim strip for use around window and door openings that includes a unitary body having an elongate first planar portion and an elongate second planar portion. The first planar portion has a first edge and a second edge. The second planar portion is positioned in parallel spaced relation to the first planar portion and also has a first edge and a second edge. The second edge of the second planar portion is connected to the second edge of the first planar portion. At least one third planar portion is secured substantially perpendicularly to the first edge of the first planar portion and extends transversely in spaced relation past the first end of the second planar portion.

According to another aspect of the present invention there is provided a method of installing a trim strip around window and door openings of a building. A first step involves providing a building with a "J" strip trim or equivalent surrounding either a window casing or a door casing. For the purpose of this description we will use a window casing. The "J" strip trim has a hook portion and a tail portion. A second step involves providing a trim strip, as described above. A third step involves inserting the second planar portion of the trim strip into the "J" strip between the hook portion of the "J" strip and the building. A fourth step involves inserting the third planar portion between the "J" strip and the window casing.

The trim strip, as described above, is a "snap on" trim that can be used to enhance the appearance, at minimal cost, of any house, provided a "J" strip trim or equivalent is first attached to surround the window or door opening. The trim is applied without any damage to the home, as no nails, screws or caulking is required. The trim can be made available in a variety of shapes, sizes, and colours. As it applies over the existing finish and is free-floating, it can be installed over uneven surfaces. If the home owner gets tired of the look provided by the snap on trim after a few years, it can readily be replaced with another variety of snap on trim.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
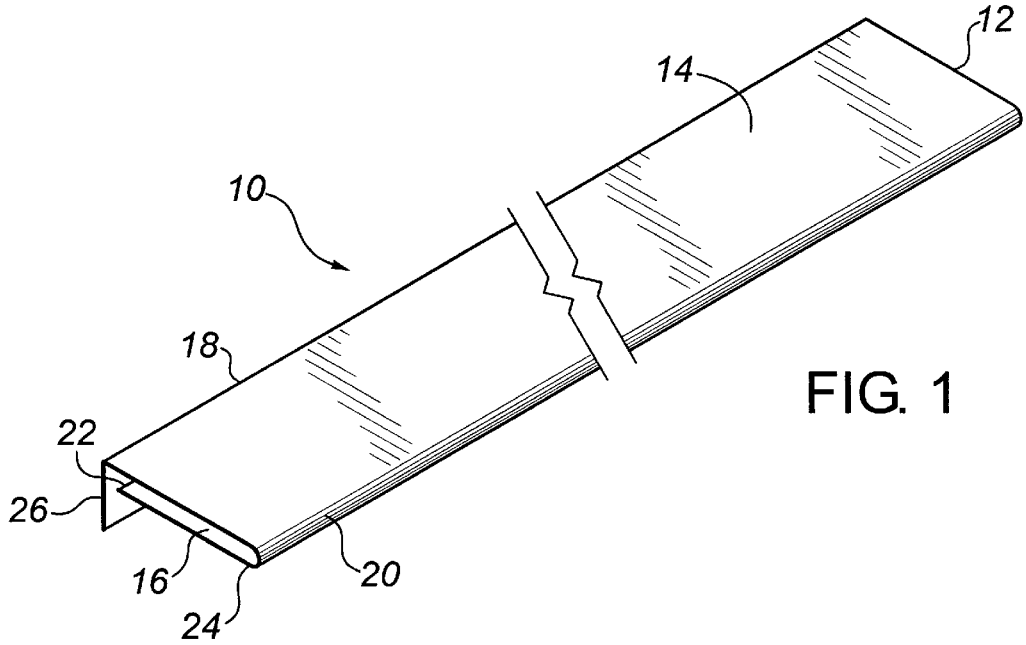
FIG. 1 is a perspective view of a trim strip that has been fabricated in accordance with the teachings of the present invention.

The preferred embodiment, a trim strip generally identified by reference numeral 10, will now be described with reference to FIGS. 1 through 3.

Structure and Relationship of Parts:

Referring to FIG. 1, trim strip 10 includes a unitary body 12 having an elongate first planar portion 14 and an elongate second planar portion 16. First planar portion 14 has a first edge 18 and a second edge 20. Second planar portion 16 is positioned in parallel spaced relation to first planar portion 14 and also has a first edge 22 and a second edge 24. Second edge 24 of second planar portion 16 is connected to second edge 20 of first planar portion 14. A third planar portion 26 is secured substantially perpendicularly to first edge 18 of first planar portion 14 and extends transversely in spaced relation past first end 22 of second planar portion 16.

Operation:

The preferred method of installing trim strip 10 will now be described with reference to FIGS. 1 through 3. As a building with siding 28 is the most difficult application, it will be used as an example. It will be appreciated that trim strip 10 can be installed on buildings having other exterior finishes.

A first step involves providing a building having "J" strip trim 30 or equivalent surrounding either a window casing or a door casing. "J" strip trim 30 has a hook portion 34, a tail portion 36, and a connecting portion 38. For the purpose of this description we will use a window casing 32 as illustrated in FIG. 2.

A second step involves providing a trim strip 10, as illustrated in FIG. 1.

Figure 2:
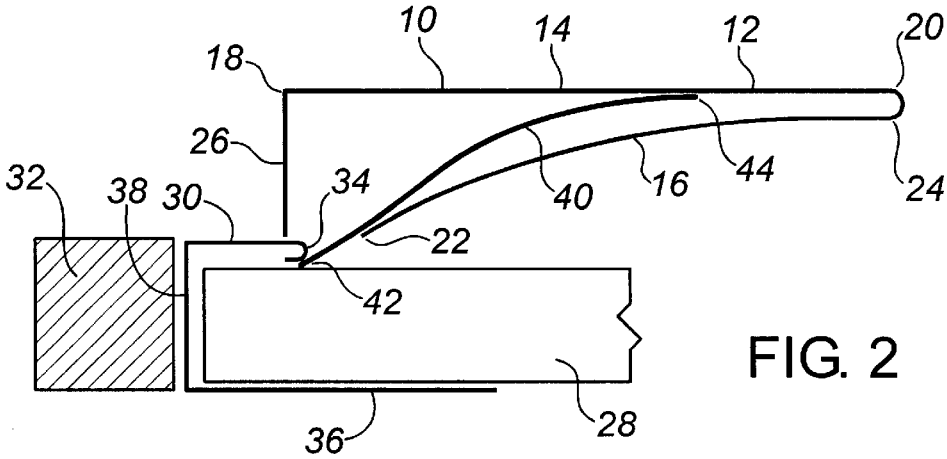
FIG. 2 is a side elevation view, in section, illustrating a preferred method of installing the trim strip illustrated in FIG. 1 around a window opening.

A third step involves inserting second planar portion 16 of trim strip 10 into "J" strip 30 between hook portion 34 of "J" strip 30 and siding 28 as illustrated in FIG. 2. A planar tool 40 may be used facilitate the insertion of second planar portion 16 of trim strip 10 in "J" strip 30. Planar tool 40 has a first edge 42 and a second edge 44. In this instance, planar tool 40 is a separate piece of vinyl siding with a slightly narrower width than trim strip 10 however it will be appreciated that other devices may be used. Planar tool 40 is inserted between first planar portion 14 and second planar portion 16. Pressure is then exerted on planar tool 40 so as to leverage second planar portion 16 away from first planar portion 14. First edge 42 of planar tool 40 is inserted between underlying hook portion 34 of "J" strip 30 and existing siding 28. As trim strip 10 is pushed toward window casing 32, second edge 44 of planar tool 40 slides toward second edge 24 of second planar portion 16 while first edge 42 of planar tool 40 slides underneath hook portion 34 so as to serve as a guide for second planar portion 16 to slide underneath hook portion 34 and toward connecting portion 38 of "J" strip trim 30. Once second planar portion 16 is in position, planar tool 40 is then removed from between first planar portion 14 and second planar portion 16.

Figure 3:
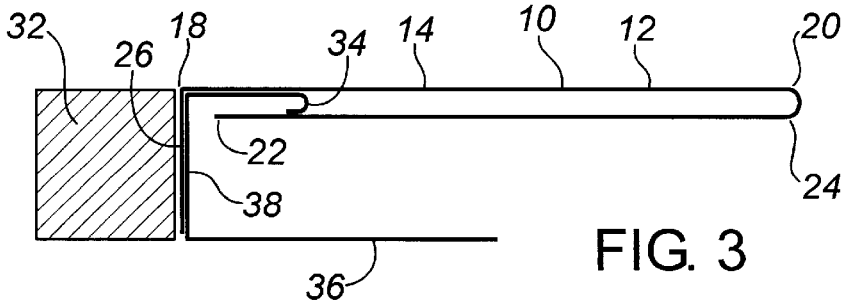
FIG. 3 is a side elevation view, in section, of the trim strip illustrated in FIG. 1, installed around a window opening.

A fourth step involves inserting third planar portion 26 of trim strip 10 between connecting portion 38 of "J" strip 30 and window casing 32 as illustrated in FIG. 3.

Variations and Alternative Embodiments:

Although first planar portion 14 and second planar portion 16 of trim strip 10 are illustrated as being rectangular, it will be appreciated that second edges 20 and 24 may be scalloped or have some other decorative treatment.

Although third planar portion 26 is shown as being a single rectangular member, as its sole role is to prevent removal of trim strip 10, it may be made with several discrete fingers rather than as a single piece.

Cautionary Warnings:

Trim strip must be made from a material that is thin enough and flexible enough to be inserted, as illustrated and described. Beneficial results have been obtained through the use of aluminum or vinyl.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A trim strip for use around window and door openings, comprising:

a flexible resilient unitary body having an elongate first planar portion having a first edge and a second edge;

an elongate second planar portion in parallel spaced relation to the first planar portion, the second planar portion having a first edge and a second edge;

the second edge of the second planar portion being connected to the second edge of the first planar portion;

at least one third planar portion secured to and extending substantially perpendicularly from the first edge of the first planar portion and toward the second planar portion crossing transversely in spaced relation past the first edge of the second planar portion.

2. The trim strip as defined in claim 1, wherein the first planar portion and the second planar portion are both rectangular.

3. The trim strip as defined in claim 1, wherein there is only one third planar portion.

4. The trim strip as defined in claim 3, wherein the third planar portion is rectangular.

5. A method of installing a trim strip around window and door openings of a building, comprising the steps of:

providing a building having "J" strip trim surrounding one of a window casing and door casing, the "J" strip having a hook portion and a tail portion;

providing a trim strip comprising a flexible resilient unitary body having:

an elongate first planar portion having a first edge and a second edge;

an elongate second planar portion in parallel spaced relation to the first planar portion, the second planar portion having a first edge and a second edge;

the second edge of the second planar portion being connected to the second edge of the first planar portion; and at least one third planar portion secured to and extending substantially perpendicularly from the first edge of the first planar portion and toward the second planar portion crossing transversely in spaced relation past the first end of the second planar portion;

inserting the second planar portion of the trim strip into the "J" strip between the hook portion of the "J" strip and the building;

inserting the at least one third planar portion between the "J" strip and the one of the window casing and the door casing.

* * * * *